US006085803A

United States Patent [19]

Dewispelaere

[11] Patent Number: 6,085,803

[45] Date of Patent: Jul. 11, 2000

[54] SPRING SUPPORTED HOOK ARRANGEMENT IN A SHED FORMING DEVICE

[75] Inventor: Andre Dewispelaere, Kortrijk/Marke, Belgium

[73] Assignee: N.V. Michel Van de Wiele, Kortrijk/Marke, Belgium

[21] Appl. No.: 09/233,106

[22] Filed: Jan. 19, 1999

[30] Foreign Application Priority Data

Jan. 19, 1998 [BE] Belgium ..... 09800036

[51] Int. Cl.[7] ..... D03C 3/12; D03C 3/20

[52] U.S. Cl. ..... 139/455

[58] Field of Search ..... 139/455

[56] References Cited

U.S. PATENT DOCUMENTS

| | | | |
|---|---|---|---|
| 4,515,186 | 5/1985 | Durville et al. | 139/455 |
| 4,739,806 | 4/1988 | Palau et al. | 139/455 |
| 5,133,389 | 7/1992 | Griffith | 139/455 |
| 5,176,186 | 1/1993 | Bousfield et al. | 139/455 |
| 5,743,308 | 4/1998 | Bassi et al. . | |
| 5,839,481 | 11/1998 | Bassi et al. | 139/455 |

FOREIGN PATENT DOCUMENTS

| | | |
|---|---|---|
| 0 723 041 | 7/1996 | European Pat. Off. . |
| 0 779 384 | 6/1997 | European Pat. Off. . |

*Primary Examiner*—Andy Falik
*Attorney, Agent, or Firm*—James Creighton Wray; Meera P. Narasimhan

[57] ABSTRACT

A shed-forming device for individually controlling heddles for the warp threads of a weaving device has hook elements which are connected to the heddles for the warp threads. Upward and downward moving knives are provided for the hook elements can hook onto. The hook elements have spring elements on a supporting element or carriage. Actuators are provided which influence the spring elements to allow the hook elements to selectively hook or not hook onto the upward and downward moving knives. Each hook element is provided with at least three spring elements in the form of spring legs. At least two spring elements are made as at least double laminated springs. At least two of the spring legs are provided with hooks destined to work together with moving knives. One or more actuators are provided which can selectively influence the various spring elements. Retaining hooks are provided for at least a part of the spring elements in a position influenced by an actuator.

13 Claims, 3 Drawing Sheets

SPRING SUPPORTED HOOK ARRANGEMENT IN A SHED FORMING DEVICE

BACKGROUND OF THE INVENTION

The invention relates to a device for shed forming whereby the position of the heddles for the warp threads in a weaving machine are individually controlled according to the open-shed principle. In such a shed-forming device the heddles for the warp threads can occupy two positions: Bottom, i.e. below the weft insertion level, and Top, i.e. above the weft insertion level. It is called an open shed when each position can be reached or be maintained on every pick.

From the British patent publication GB 2 047 755 a shed-forming device for a weaving machine is known whereby the arcades are suspended from a pulley element. Around the wheel of this pulley element a cord is passed of which each extremity is connected to a leaf-spring-shaped hook. Each leaf-spring-shaped hook is provided on the bottom part with a nose with which it can rest on a corresponding lifting knife. The knives are brought two by two in opposite phase in an upward and downward movement. The leaf spring hooks are provided on top with a hook with which in a top position they can hook onto a fixed knife through the influence of an electromagnet which is placed between two leaf springs that work together. The nose of the bottom part of the leaf-spring-shaped hooks however always remains in the path of the ascending and descending lifting knives that work together. An unselected hook always remains on its corresponding lifting knife. The "bottom" positions for the leaf spring hooks are therefore formed by the moving lifting knives.

With this existing system the pulley device is a great disadvantage. At high weaving speed the reversing rollers of the pulley device have to rotate fast backward and forward. Heat develops through the friction which occurs in the bearing of the wheel and through slipping of the cord on the groove surface of the wheel. The cord must bendingly unwind onto the reversing roller at high frequency. This cord is subject to wear and tear and finally breaks. It also often occurs that through the dust in the weaving area the wheel will jam, through which the cord prematurely breaks through severe friction. After a time all pulley elements have to be preventively replaced when the number of pulley cord breakages becomes too great and because of this the weaving efficiency of the weaving installation will decrease. The replacement of thousands of pulleys per weaving unit is time-consuming, requires specialized personnel and because of this causes an increase in running costs.

EP 0 711 856 describes an attempt at remedying these disadvantages by operating without any pulley element. This device however has the disadvantage that a preselection of the hooks must take place with the implementation of a small lift at the frequency of the weft insertion frequency. In other words the selectors and the grids on which these are mounted must perform an upward and downward movement during a weft insertion cycle. This leads to severe vibrations at high operating speed of e.g. 1,000/min. Another disadvantage is that the lifting knives must be provided with spring catch hooks which drag against the jacquard hooks. This develops heat and is the cause of considerable mechanical loss.

Another attempt according to EP 0 779 384 also has the intention of being able to operate without pulley element. The disadvantage of that technique is that a two-legged hook is required whereby the harness load in each case comes in the middle, through which the hooks are eccentrically loaded. In order to offset this eccentric loading a central guiding body has to be provided. This however causes extra friction through which this device also suffers high mechanical losses. Because of the fact that this solution rests on a two-legged hook this device takes up rather a lot of room in horizontal plane. The footprint is rather large.

Shed-forming devices are also utilized in three-position jacquard machines such as namely those employed with face-to-face double gripper weaving machines for weaving jacquard velvet and for weaving multiple pile warp thread carpets. With a double gripper weaving machine in each weft insertion cycle two wefts are simultaneously inserted. This means that the pile warp threads can occupy three positions:

Bottom: below both weft insertion means

Middle: between the two weft insertion means

Top: above both weft insertion means.

It is called a three-position open-shed jacquard machine when each position of the three positions can be reached or continue to be maintained on every pick or weft insertion cycle. Three-position open-shed jacquard machines are implemented by providing two hooks of a two-position open-shed jacquard machine with a pulley device. The importance of three-position open-shed jacquard machines for weaving jacquard velvet and multiple pile warp thread carpets is that pile weave corrections can be applied at the time of color transitions where this appears necessary in order to avoid mixed contours and double tufts on the pile side when using the two-shot weave.

From the French patent publication no. 1.225.173 a three-position jacquard machine is known with open shed for the middle and bottom position and non-open shed for the top position. This device makes use of two card-operated hooks which are connected to each other by a pulley cord, which runs around the top wheel of a pulley device, and a bottom pulley cord which is secured to a movable grid and is re-routed over the bottom wheel in order then to be connected to the harness cord(s) with the other extremity. With this device the bottom and middle position can be reached or maintained on every pick, the top position can only be reached on every second pick. The disadvantage of this device is the use of pulley cords. Through the repeated passing around and the friction of the cords on the wheels, the cords are subject to wear and tear through which they will break. A device also has to be provided in order to move the bottom pulley grid.

From the French patent publication no. 1.513.410 a three-position open-shed jacquard machine is known which makes use of two hooks of a two-position open-shed jacquard machine and one pulley element. The device makes use of two hooks: this means that for a specific number of cords with three positions, a double capacity in hooks has to be installed. The pulley cords are here again the weak element of the device. With the higher weaving speeds, which are customary at present, the pulley cords break prematurely.

From the French patent publication no. 2 466 541 a similar device is known, but with a movement reinforcement built into the pulley device. The disadvantage of this device is also here the use of twice the number of hooks and pulley cords, and the extra reversing roller which is necessary for the movement reinforcement.

From the European patent publication no. 0 399 930 a device is known which makes use of two complementary hooks, each with its own pulley and one reversing roller in order to achieve the three-position open shed. With this pulley device the pulley cords are passed around in two planes standing perpendicular to each other through which the pulley cords break through fatigue and wear and tear of the fibers in the pulley cords. Here two neighboring hooks are also necessary in order to obtain a three-position device.

These known devices all have the disadvantage that the pulley cords of the pulley device are subject to wear and tear and that the pulley cords will break, which makes premature replacement necessary. This problem becomes more serious with current weaving speeds.

This invention now has the purpose of providing a shed-forming device which prevents the deficiencies and disadvantages of the state-of-the-art, and which is suitable for being used on jacquard devices of different types, namely two-position open-shed jacquard machines and three-position open-shed jacquard machines.

SUMMARY OF THE INVENTION

For this purpose the shed-forming device according to the invention comprises hook elements which are connected to the heddles for the warp threads, and upward and downward moving knives to which the hook elements can hook onto, whereby the hook elements are provided with spring elements and whereby actuators are provided which can influence the spring elements in order to allow the hook elements selectively to hook or not hook onto the upward and downward moving knives. According to the invention each hook element is moreover provided with at least two spring elements, made at least as double laminated springs, at least two of the spring legs are provided with hooks, destined to work together with the moving knives, one or more actuators are provided on a selector frame of the shed-forming device which can selectively influence the various spring elements, and retaining hooks are provided for at least a part of the spring elements in a position influenced by an actuator.

According to one specific embodiment of the invention, destined for a two-position open-shed jacquard device, each hook element preferably comprises a supporting element that is provided on both sides with two spring legs of different lengths, in the form of one double spring element on both sides of the supporting element, whereby each of the longest legs on both sides of the supporting element is provided with a hook, destined to work together with a knife moving in opposite phase on both sides of the hook element, while each selector frame comprises an actuator in order to influence the spring legs, whereby on both sides of every hook element a retaining hook is provided on or nearby the actuator which retaining hooks retain the shortest spring legs in the position influenced by the actuator.

According to a further characteristic of the invention the double spring element can moreover be made in the form of a double laminated spring element or in the form of a double split spring element.

The problem in this embodiment of the invention is therefore namely solved by providing the device with a carriage which is guided in a channel mounted in the selector frame. On this carriage on both sides a double laminated hook is provided. The double laminated hook has a long leg and a short leg. The entirety of the carriage and both double laminated complementary hooks is for the rest simply called a hook. The carriage is provided with a projection for resting on a fixed bottom grid when the hook is not lifted. Above this fixed grid are two knives which can be moved upward and downward in opposite phase in order to lift the hooks. These knives each move in a different plane. The complementary hooks are made of a magnetic material such as e.g. steel. A means is provided in order to act on the hooks and to make these bend through which these cannot be carried by the moving knives. This means is e.g. an electromagnetic coil. The electromagnetic coil is also provided with a projecting hook in order to be able to hold up the complementary hook with the short leg in its top position.

According to another specific embodiment of the invention, destined for a three-position open-shed jacquard device, each hook element preferably comprises a supporting element that is provided on both sides with at least two spring legs, in the form of a double laminated, possibly partially double spring element on both sides of the supporting element, while in each case a longer leg of the double laminated spring element on both sides of the supporting element is provided with one hook, destined to work together with a top knife moving in opposite phase on both sides of the hook element, while in each case a shorter leg of the double laminated spring element is provided on both sides of the supporting element with two hooks, destined to work together at different heights with a bottom knife moving in opposite phase on both sides of the hook element, whereby each hook element comprises three actuators for influencing the spring legs in different positions of the hook element, and whereby on both sides of each hook element one or more retaining hooks are provided in order to be able to retain the hook element at selected heights when one or more of the actuators so influence the spring legs that the hooks on the corresponding spring legs do not hook onto the upward and downward moving knives.

The problems in this embodiment of the invention are namely therefore solved by no longer using a pulley device with pulley cords for implementing the three positions. In order to implement the three positions firstly four knife systems are provided. The knives move in opposite phase two by two in one and the same vertical plane. Secondly a hook is provided which consists of a carriage or a trolley, to which two complementary hooks are connected. Between the complementary hooks an intermediate space is provided for the means for acting on the legs of the hook. Each complementary hook consists of three legs. Thirdly for each leg of the complementary hook a means is provided in order to be able to act on the leg of the hook in order to make these bend. These means are e.g. electromagnetic coils. Fourthly a holding hook with operating actuator is provided in order to hold the hook in middle or top position. Fifthly on a number of legs further hooks are provided at a distance which takes the removal play into account. The removal play is the distance between the top of the knife and bottom of the hook of each leg of the hook that is in front of the knife. A removal play is necessary in order to be able to remove the leg from the knife. Finally on the hook carriage a nose is provided with which the hook rests in the bottom position on a fixed bottom grid.

According to a preference of the invention the actuators are more specifically electromagnetic and/or piezoelectric actuators.

The characteristics and distinctive features of the invention, and the operation thereof are further explained hereafter with reference to the attached drawings which show four preferred embodiments of the invention. It should be noted that the specific aspects of these embodiments are only described as preferred examples of what is intended in the scope of the above general specification of the invention, and must in no way be interpreted as a restriction on the scope of the invention as such and as expressed in the following claims.

DETAILED DESCRIPTION OF THE PREFERRED EMBODIMENTS

Figure 1:
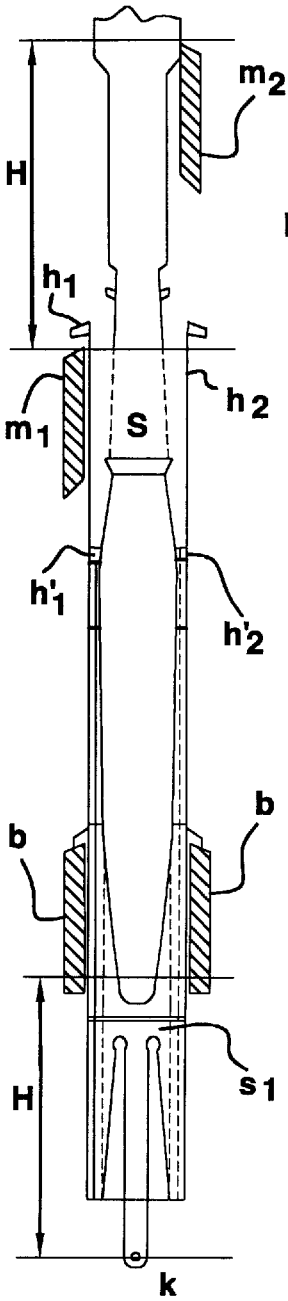
FIGS. 1 through 3: are side views of a shed-forming device according to the invention, in a specific embodiment for a two-position open-shed jacquard device, shown in different positions of the hook element and of the knives.
Figure 2:
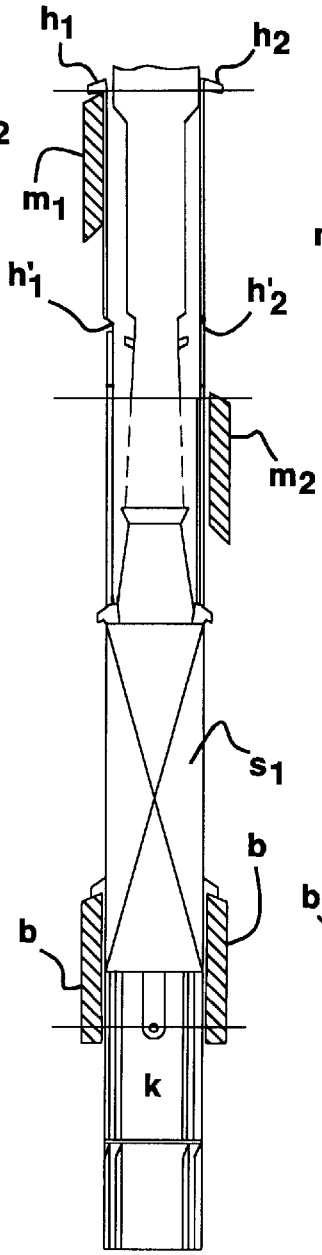
Figure 3:
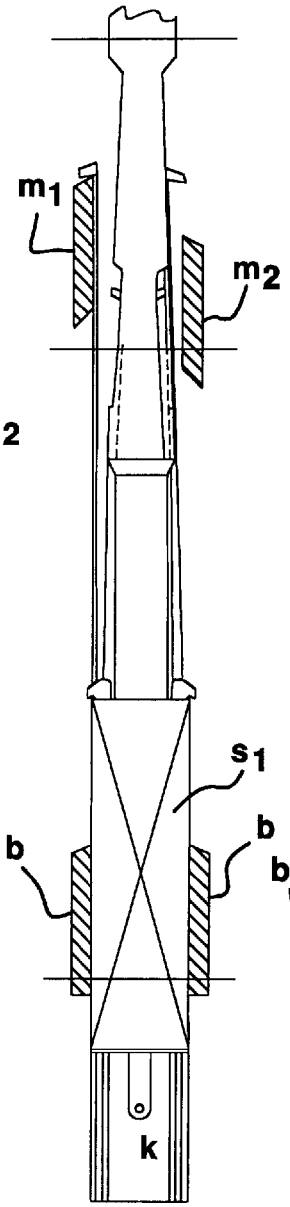

In FIGS. 1–3 a shed-forming device is shown, according to an embodiment of the invention destined for a two-position open-shed jacquard device. The pairs of knives $m_1$ and $m_2$ move in opposite phase upward and downward over a lift H. Between these knives is a selector with coil S and a projecting hook. The legs $h_1$ and $h_2$ with carriage sl move between these knives. A position whereby the hook rests on the bottom grid b and the two lifting knives $m_1$ and $m_2$ are in their dead point of lifting, is represented in FIG. 1. The complementary hooks $h_1$ and $h_2$ are with their top in front of coil S. The long legs $h_1$ and $h_2$ have a hook on the top with which these can be hooked onto the knives $m_1$ or $m_2$. The short legs $h'_1$ and $h'_2$ have a hole or a window opening with which these short legs can be hooked onto the projecting hook on the frame of the coil S.

When according to the pattern to be woven the hook has to remain below in the bottom position on the following pick, the coil will be triggered, through which the hook $h_1$ is bent away from the knife $m_1$. In its upward movement the knife $m_1$ will not be able to carry along the hook $h_1$, and the hook remains in the bottom position. In its movement to the bottom position the knife $m_2$ with its underside reaches the top of the leg $h_2$. In order to make this leg $h_2$ veer away a suitably bevelled form will be given to the bottom of the knife $m_2$ or appropriately the coil S will be triggered again in order to make the leg $h_2$ bend.

Figure 4:
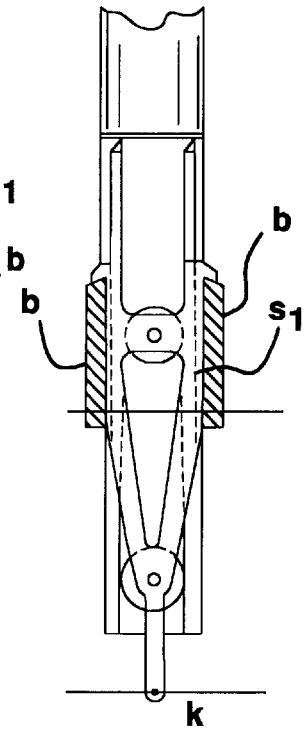
FIG. 4: is a partial view, partly in cross-section, of a variant of the shed-forming device according to FIGS. 1–3.

When according to the pattern to be woven the hook has to be on top on the following pick, the coil S will not be triggered. The leg $h_1$ or $h_2$ is not bent and is carried by the knife $m_1$ respectively $m_2$ to top position (see FIG. 2). The other complementary hook also moves upward with the carriage. The harness cord(s) k hang in the middle of the carriage. The carriage is lifted on one side by the leg $h_1$ or $h_2$: this causes an overturning moment. In order to offset this overturning moment the carriage is provided with wings which form a sliding set with a channel in the selector frame (see FIG. 2). This channel can be formed by grooves in the separation wall of the selector frame. The carriage has by way of an example an I-shaped cross-section (see FIG. 1). The carriage forms a sliding set with the selector frame. The guide can also be formed by a groove in the selector frame (see FIG. 4). In this groove run two wheels which are attached to the carriage. The guide consists in this case by way of example of a roller and slot set.

In order to hold a hook in the top position, the coil S will be triggered, through which the short leg $h'_1$ or $h'_2$ with the window opening is hooked onto the projecting hook of the coil S and through which the hook cannot descend. In order not to hold the hook on top the coil S will not be triggered, through which the hook together with the corresponding knife goes down again. During that descent the hook in the leg $h_2$ will again meet the knife $m_2$ and would be engaged by this knife. In order to prevent this the coil S will be triggered at that time through which the leg $h_2$ is removed from the knife $m_2$ (see FIG. 3). The same can be repeated for the leg $h_1$ and the knife $m_1$.

From the preceding specification it is seen that each hook can be held in its position or can be moved to the other second position. The device therefore complies with the open-shed principle. The device works without pulley cords and can be built compactly in height. Only one selection element is necessary.

The parts of the complementary hooks can also be located next to each other in the same plane. The entirety of selector coil S, carriage sl and legs $h_1$ and $h_2$ can be accommodated in a cassette or module.

In FIGS. 5–12 a shed-forming device is shown, according to an embodiment of the invention destined for a three-position open-shed jacquard device.

In this embodiment of the invention the problems are also solved by no longer using a pulley device with pulley cords in order to implement the three positions. In order to implement the three positions firstly four knife systems $m_1$, $m_2$, $m_3$ and $m_4$ are provided. The knives $m_1$ and $m_3$ and the knives $m_2$ and $m_4$ move two by two in one and the same vertical plane. See FIG. 5. The knives $m_1$ and $m_2$ perform a lift equal to (2H) in opposite phase: i.e. when the knife $m_1$ is in the bottom dead point, then the knife $m_2$ is in the top dead point. The knives $m_3$ and $m_4$ perform a lift equal to (H) in opposite phase. Secondly a hook is provided which consists of a carriage (sl) or a trolley, to which two complementary hooks are connected. Between the complementary hooks an intermediate space is provided for the means for acting on the legs of the hook. Each complementary hook consists of three legs: a long leg $h_1$ and $h_2$ each with a hook on the top, a short leg $h_3$ and $h_4$ with two hooks, one on the top and one at a certain distance from the top hook, and a short holding leg $h_5$ and $h_6$ with two window openings. The long and short leg work together with their respective knives $m_i$. Thirdly for each leg of the complementary hook means $S_1$ and $S_2$ are provided in order to be able to act on the legs of the hook in order to make these bend. These means are e.g. electromagnetic coils. Fourthly a holding hook k with operating actuator $S_3$ is provided in order to hold the hook in middle or top position. For that purpose the frame of the means $S_3$ is provided with two projecting hooks k. Fifthly on each short leg $h_3$ and $h_4$ a second hook $h'_3$ and $h'_4$ is provided at a distance equal to (H−2×removal play). The removal play is the distance between the top of the knife and bottom of the hook of each leg of the hook that is in front of the knife. A removal play is necessary in order to be able to remove the leg from the knife. Finally on the hook carriage a nose is provided with which the hook rests in the bottom position on a fixed bottom grid.

In FIGS. 5–10 the legs of the complementary hooks are for the sake of simplicity schematically represented with each leg situated in a different plane. The long leg can however be situated in one plane and the short legs next to each other in an adjacent plane, see FIG. 11. The hooks of the leg $h_3$ and $h'_3$, respectively $h_4$ and $h'_4$ work through window openings in the long legs $h_1$ and $h_2$. All three of the legs can also be situated next to each other in the same plane. The harness cords which lift up the jacquard heddle—not represented in the figures—are attached to the carriage at the bottom of the hook on a shank. A spring load constantly pulls the hook downward. The knives serve to lift the hooks upward or downward against the spring load.

The means for acting on the legs of the complementary hooks are placed in the space provide between the complementary hooks $h_1$-$h_3$-$h_5$ and $h_2$-$h_4$-$h_6$. The means $S_1$, $S_2$ and $S_3$ act on one side on the legs $h_1$-$h_3$-$h_5$ and on the other side on the legs $h_2$-$h_4$-$h_6$.

Figures 5, 6, 7, 8:
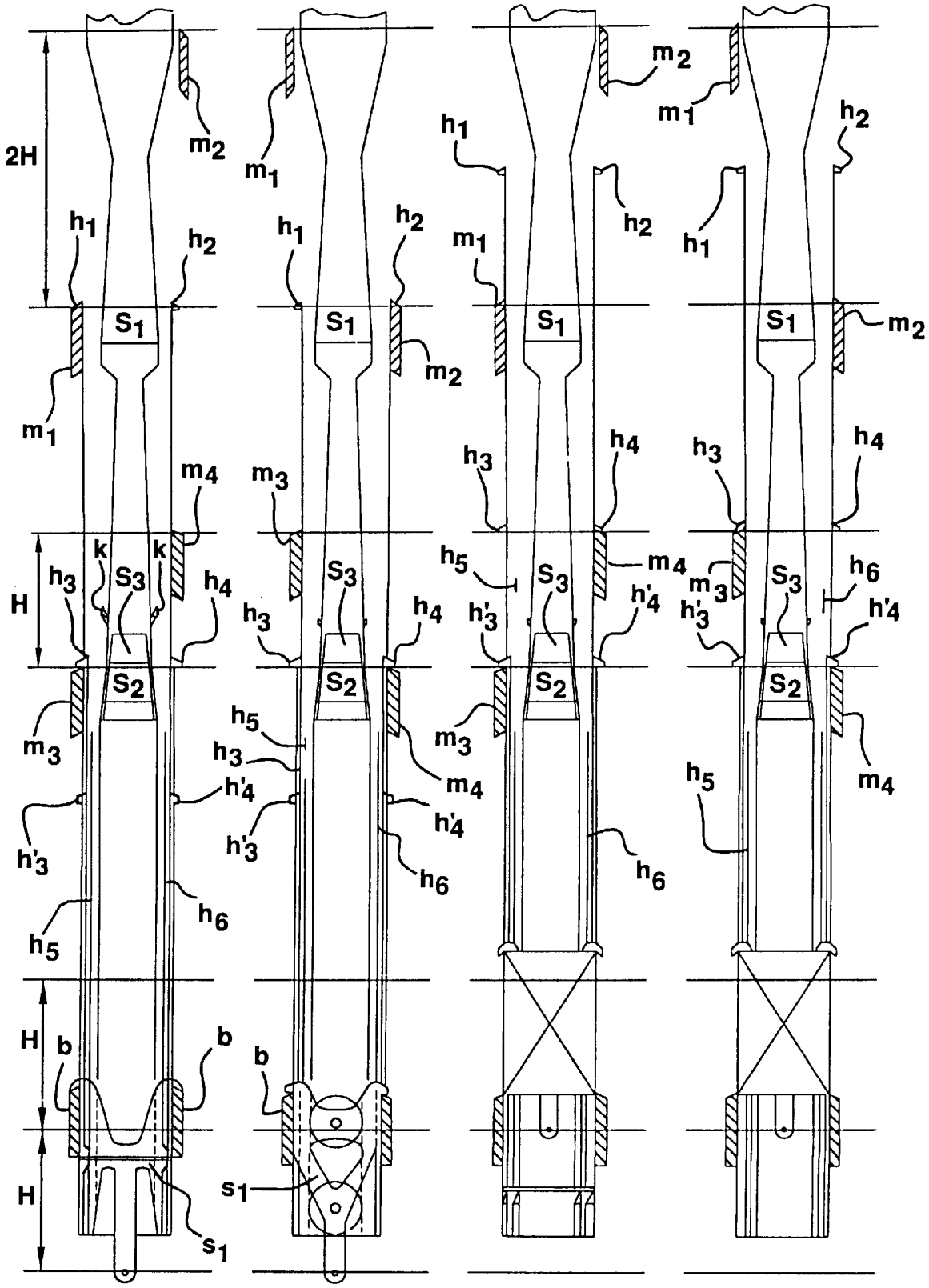
FIGS. 5 through 10: are side views, partly in cross-section, of a number of variants of a shed-forming device according to the invention, in a specific embodiment for a three-position open-shed jacquard device, shown in different positions of the hook element and of the knives.
Figure 10:
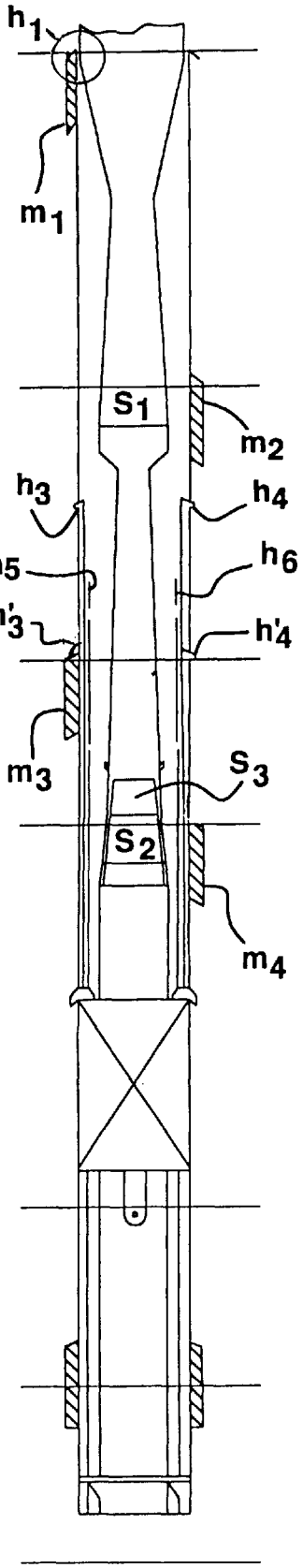
Figure 11:
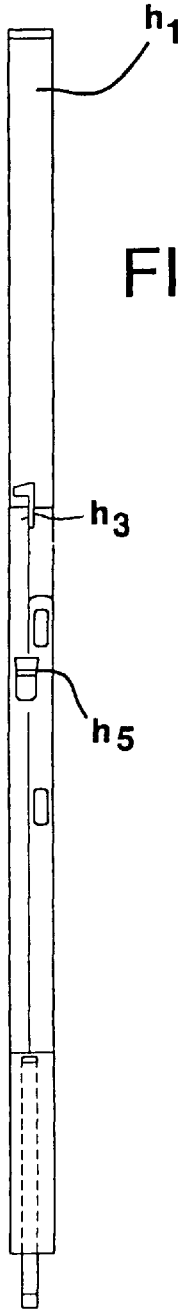
FIG. 11: is a front view of a hook element for a shed-forming device according to FIGS. 5–10.

In the bottom position the hook rest on the fixed bottom grid b. In FIG. 5 this position is represented with the knives $m_1$ and $m_3$ in their bottom dead point and with the knives $m_2$ and $m_4$ in their top dead point. In FIG. 6 the other position is represented. These positions are cyclically repeated every second pick or weft insertion cycle. In FIGS. 7 and 8 the hook is represented in the middle position and in FIGS. 9 and 10 in the top position, in each case with the respective positions of the lifting knives. In FIG. 11 an embodiment of the hook is shown which is preferred: each complementary hook consists of a long wide leg, a short leg and a short holding leg which lie next to each other in an adjacent plane. The hooks of the short leg work through window openings in the long leg. Every such complementary hook is attached to a carriage or roller trolley in order to form one hook.

When a complementary hook is carried along by a knife, then the harness cord pulls with spring load eccentrically on the complementary hook: an overturning moment develops. In order to cancel out this overturning moment just the carriage is now provided with a guide, see FIG. 5 and FIG. 7. The carriage can also be implemented as a roller trolley with guide, see FIG. 6 and FIG. 9.

Figure 12:
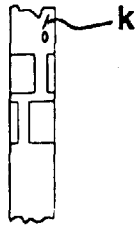
FIG. 12: is a front view of a part of the shed-forming device according to FIGS. 5–11, which shows the position of two actuators thereon.

The hooks k provided on the coil body of $S_3$ serve to hold the complementary hooks with the holding legs $h_5$ and $h_6$ in the middle or top position. The hooks k are placed in the path plane of the holding-up hook $h_5$ and $h_6$ outside the movement path of the leg $h_3$ and $h_4$ in order to impede the veering away of these legs. In FIG. 12 operating actuators $S_2$ and $S_3$, with hook k, are shown in front view, in an embodiment, which is preferred, for working together with a hook according to FIG. 11.

In the place of hooks k a catch system can also be provided, which is operated by an actuator $S_3$. The actuator $S_3$ then makes the catches engage or release. These catches therefore work in openings which are provided in the legs.

When according to the prescribed pattern the hook has to remain at the bottom on a following pick, the coils $S_1$ and $S_2$ will be triggered in order to make the legs $h_1$ respectively $h_3$ bend, so that these cannot be carried by the ascending knives $m_1$ and $m_3$. Instead of coils other means can also be provided for making the legs bend. The knives $m_1$ and $m_3$ move upward, and the knives $m_2$ and $m_4$ downward. At the end of this movement the bottom of the knives $m_2$ and $m_4$ will strike against the top of the legs $h_2$ and $h_4$. In order to prevent this the bottom of the knives will be given a bevelled form, so that the top of the hooks can be mechanically pressed away by the knives. Also at that time the coils $S_1$ and $S_2$ can be suitably triggered again in order to make the legs veer away, so that the hooks on those legs come out of reach of the knives. This action will henceforth be referred to as an avoiding action. The hook therefore remains resting on the bottom grid b and remains in the bottom position as represented in FIG. 6.

If the hook on the following pick again has to remain in the bottom position, then coils $S_1$ and $S_2$ will be triggered in order to bend the legs $h_2$ and $h_4$ away from the knives $m_2$ and $m_4$. At the end of their movement the bottom of the knives $m_1$ and $m_3$ will strike against the top of the legs $h_1$ and $h_3$. In order to prevent this the bottom of the knives will be given a bevelled form, so that the top of the hooks can be mechanically pressed away. At that time an avoiding action can also suitably be performed, by triggering the coils $S_1$ and $S_2$ in order to make the legs bend, so that the hooks of these legs come out of reach of the knives. The hook therefore remains resting on the bottom grid b and remains in the bottom position as represented in FIG. 5.

When a hook according to the prescribed pattern has to move from the bottom position to the middle position this is only possible by changing from the position represented in FIG. 5 to the position in FIG. 8 or from the position represented in FIG. 6 to the position in FIG. 7, in view of the movement sequence of the knives.

In order to bring a hook from the bottom position, situation represented in FIG. 5, into the middle position, represented in FIG. 8, coil $S_1$ will be triggered in order to hold the top of the leg $h_1$ out of reach of knife $m_1$. The hook will be carried with leg $h_3$ by the ascending knife $m_3$ over a lift equal to (H−removal play) to the middle position, where leg $h_3$ remains resting on knife $m_3$. The knives $m_2$ and $m_4$ in their descending movement meet the tops of the ascending hooks $h_2$, $h_4$ and $h'_4$. In order to prevent passing strikes the bottom of the knives will be suitably bevelled and an avoiding action will be performed by again triggering the coils $S_1$ and $S_2$ at that time. The hook rests with leg $h_3$ on the knife $m_3$, see FIG. 8, and in order to be able to remove leg $h_4$ from the knife $m_4$, the second hook $h'_4$ on the leg $h_4$ will be placed at a distance from the top hook equal to (H−2×removal play).

In order to bring a hook from the bottom position, situation represented in FIG. 6, into the middle position, situation represented in FIG. 7, coil $S_1$ will be triggered in order to hold the top of the leg $h_2$ out of reach of the knife $m_2$. The hook will be carried with leg $h_4$ by the ascending knife $m_4$ over a lift equal to (H−removal play) to the middle position, where the leg $h_4$ remains resting on the knife $m_4$. The knives $m_1$ and $m_3$ in their descending movement meet the tops of the ascending hooks $h_1$ and $h_3$. In order to prevent a collision the bottom of the knives will be suitably bevelled and an avoiding action will be performed by triggering the coils $S_1$ and $S_2$ at that time. The hook rests with leg $h_4$ on the knife $m_4$, see FIG. 7, and in order to be able to remove leg $h_3$ from the knife $m_3$, the second hook $h'_3$ on the leg $h_3$ will be placed at a distance from the top hook equal to (H−2×removal play).

The hooks can also be brought from middle position to bottom position. In order to bring a hook from middle position, in FIG. 8, to the bottom position, of FIG. 5, coil $S_2$ will be triggered. The hook $h'_4$ is removed from knife $m_4$, the hook remains resting with the leg $h_3$ on the knife $m_3$ and will move down with this knife. The descending hook will meet the ascending knife $m_2$ with leg $h_2$ and in order to prevent an engagement an avoiding action will be performed by triggering coil $S_1$ at that time. The hook on leg $h_4$ also meets knife $m_4$ and in order to prevent an engagement an avoiding action will also be performed here by again triggering coil $S_2$ at that time. An avoiding action will be performed by triggering coil $S_1$ in order to make $h_1$ veer away when knife $m_1$ has to pass by that top with its underside. The hook comes into the bottom position and rests with its nose on the bottom grid b.

In order to bring the hook from the middle position, see FIG. 7, to the bottom position, see FIG. 6, the Coil $S_2$ will be triggered. The hook $h'_3$ is removed from the knife $m_3$, the hook remains resting with the leg $h_4$ on the knife $m_4$ and will move downward with this knife. The descending hook will meet the ascending knife $m_1$ with leg $h_1$ and in order to prevent an engagement an avoiding action will be performed by triggering coil $S_1$. The hook of the leg $h_3$ also meets knife $m_3$ and in order to prevent an engagement an avoiding action will also be performed here by again triggering coil $S_2$. The hook comes into bottom position and rests with the nose on the bottom grid b.

The hook can also remain in the middle position. In order to hold the hook in the middle position, from the position of FIG. 8 to that of FIG. 7, the coil $S_2$ will be triggered, through which the hook $h'_4$ is held out of reach of the knife $m_4$, and the coil $S_3$ will be triggered through which the holding legs $h_5$ and $h_6$ will with their window openings hook onto the hooks k. The hook descends with knife $m_3$ until the holding legs rest on the hooks k. The hook remains in the middle position. Knife $m_2$ has to pass by the hook of leg $h_2$ without engaging it, for that purpose a removal action will be performed by triggering coil $S_1$ at that time in order to remove the hook of the leg $h_2$ from the knife $m_2$. The knives $m_1$ and $m_3$ must respectively pass by $h_1$ and $h'_3$, for that purpose an avoiding action will be performed by triggering the coils $S_1$ and $S_2$.

In order to hold the hook from the middle position of FIG. 7 in the middle position of FIG. 8, the coil $S_2$ will be triggered, through which the hook $h'_3$ is held out of reach of the knife $m_3$, and the coil $S_3$ will be triggered in order to make the holding legs $h_5$ and $h_6$ hook with their window openings onto the hooks k. The hook descends with the knife $m_4$ until the holding legs rest on the hooks k. The hook remains in the middle position. The knife $m_1$ has to pass by the hook of leg $h_1$ without engaging it, for that purpose a removal action will be performed by triggering the coil $S_1$ at that time in order to remove $h_1$ from the knife $m_1$. The knives $m_2$ and $m_4$ must respectively pass by $h_2$ and $h'_4$, for that purpose an avoiding action will be performed by triggering the coils $S_1$ and $S_2$ at that time.

The top position can be reached from every bottom position. The transitions from the positions represented in FIG. 5 to those of FIG. 10 and those from FIG. 6 to FIG. 9 and vice versa should be demonstrated. In order to go from bottom position, as represented in FIG. 5, to the top position, as represented in FIG. 10, first no coil will be triggered. The hook will move with the knife $m_1$ over a lift equal to (2H) upward into the top position. The knife $m_2$ has to pass by leg $h_2$, for that purpose an avoiding action will be performed by triggering coil $S_1$ at that time. The hook $h'_3$ has to pass by the knife $m_3$, at that time an avoiding action will be performed by triggering the coil $S_2$. The knife $m_4$ has to pass by $h_4$ and $h'_4$, for that purpose an avoiding action will be performed by triggering coil $S_2$ at that time. The hook comes into top position and rests on the knife $m_1$.

Figure 9:
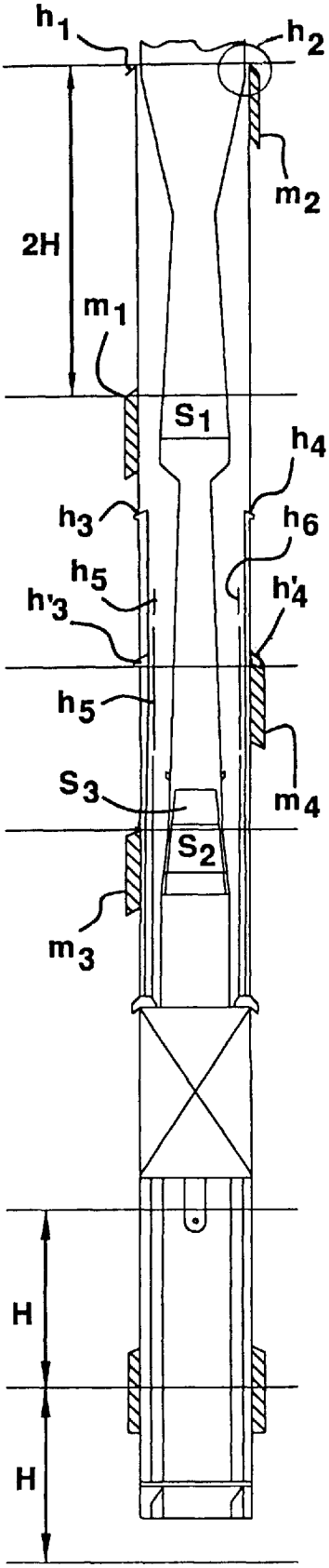

In order to go from bottom position, as represented in FIG. 6, to the top position, as represented in FIG. 9, first no coil will be triggered. The hook will move with knife $m_2$ over a lift equal to (2H) upward into the top position. The knife $m_1$ has to pass by leg $h_1$, for that purpose an avoiding action will be performed by triggering coil $S_1$ at that time. The knife $m_3$ has to pass by leg $h_3$ and hook $h'_3$, at that time the coil $S_2$ will be triggered in order to perform an avoiding action. The knife $m_4$ has to pass by hook $h'_4$, for that purpose the coil $S_2$ will be triggered at that time in order to perform an avoiding action. The hook is now in the top position and rests on knife $m_2$.

In order to go from top position, as represented in FIG. 10, to the bottom position, as represented in FIG. 5, the coil $S_2$ will be triggered, through which the hook $h'_3$ is removed from the knife $m_3$. The hook will move with knife $m_1$ over a lift equal to 2h downward into the bottom position. The knife $m_2$ has to pass by the hook of leg $h_2$ without engaging it, for that purpose a removal action will be performed by triggering coil $S_1$ at that time in order to remove the hook of the leg $h_2$ from the knife $m_2$. The hook of leg $h_3$ has to pass by the knife $m_3$, at that time a removal action will also be performed by again triggering the coil $S_2$. The hook $h'_4$ and hook of leg $h_4$ have to pass by the knife $m_4$ without engagement movement, for that purpose a removal action will be performed by triggering the coil $S_2$ at that time. The hook comes into the bottom position and now rests on the bottom grid b.

In order to go from the top position, as represented in FIG. 9, to the bottom position, as represented in FIG. 6, coil $S_2$ will be triggered, through which the hook $h'_4$ is removed from the knife $m_4$. The hook will move with knife $m_2$ over a lift equal to (2H) downward into the bottom position. The hook of the leg $h_1$ has to pass by knife $m_1$ without engagement, for that purpose a removal action will be performed by triggering coil $S_1$ at that time. The hook of leg $h'_3$ and the hook of leg $h_3$ has to pass by knife $m_3$ without engagement movement, at that time coil $S_2$ will be triggered in order to perform a removal action. The hook of leg $h_3$ has to pass by the knife $m_3$, at that time a removal action will also be performed by again triggering the coil $S_2$. The hook comes into the bottom position and now rests on the bottom grid b.

The hook can also remain in the top position. In order to hold the hook in top position through transition from the situations from FIG. 10 to FIG. 9, the coil $S_3$ will be triggered. The holding legs $h_5$ and $h_6$ will rest on the hooks k with the window openings which are provided at a distance equal to (H−2×removal play) from the top window openings. The hook because of this remains in the top position. In order to hold the hook in top position through transition from FIG. 9 to FIG. 10, the coil $S_3$ will be triggered, just as has been described above. With both transitions no removal action nor any avoiding action need be performed.

The hook can be brought from the middle position to the top position and vice versa. In order to come from the middle position, as represented in FIG. 7, to the top position, as represented in FIG. 10, no coil will be triggered. The hook is carried by the knife $m_3$ with the hook $h'_3$ over a lift equal to h and at the end of this lift the knife $m_1$ takes the hook up with the hook of the leg $h_1$. The hook rests with the leg $h_1$ on the knife $m_1$ through which between the hook $h'_3$ and the knife $m_3$ again a removal play develops. An avoiding action is performed for leg $h_2$ opposite the knife $m_2$ and for the leg $h'_4$ and the knife $m_4$ by triggering the coils $S_1$ respectively $S_2$.

In order to come from the middle position, as represented in FIG. 8, to the top position, as represented in FIG. 9, no coil will be triggered. The hook is carried by the knife $m_4$ with hook $h'_4$ over a lift (H) and at the end of this lift the knife $m_2$ takes the hook up with the hook of the leg $h_2$. The hook rests with the leg $h_2$ on the knife $m_2$ through which between the hook $h'_4$ and the knife $m_4$ again a removal play develops. An avoiding action is performed for leg $h_1$ opposite the knife $m_1$ and for the leg $h'_3$ and the knife $m_3$ by triggering the coils $S_1$ respectively $S_2$.

In order to bring back the hook from the top position, as represented in FIG. 10, to the middle position, as represented in FIG. 7, no coil will be triggered. The hook moves with the knife $m_1$ downward, the support is transferred by the hook $h'_3$ to the knife $m_3$ through which the hook will perform a descent (H) with the knife $m_3$. In order to prevent the hook of the leg $h_2$ from being engaged by the knife $m_2$, a removal action will be performed by triggering the coil $S_1$ at that time. The hook $h'_4$ may not be engaged by the knife $m_4$, for that purpose a removal action will be performed by triggering the coil $S_1$ at that time. The hook of the leg $h_4$ will finally hook onto the knife $m_4$ through which again the removal play between the hook $h'_3$ and the knife $m_3$ develops.

In order to bring back the hook from the top position, as represented in FIG. 9, to the middle position, as represented in FIG. 8, no coil will be triggered. The hook moves with the knife $m_2$ downward, the support is transferred by the hook $h'_4$ to the knife $m_4$ through which the hook will perform a descent equal to (H) with the knife $m_4$. The hook of the leg $h_1$ may not be engaged by the knife $m_1$, for that purpose a removal action will be performed by triggering the coil $S_1$ at that time. The hook $h'_3$ may not be engaged by knife $m_3$, for that purpose a removal action will be performed by triggering the coil $S_2$ at that time. The hook of the leg $h_3$ will finally hook onto the knife $m_3$ through which again the removal play between the hook $h'_4$ and the knife $m_4$ develops.

From the preceding specification it appears that each hook can be held in its position or can be moved to both other positions. The device therefore complies with the open-shed principle and this in fact for the three positions. The device works without pulley cords or any pulley.

I claim:

1. Shed-forming device for individually controlling warp threads of a weaving device comprising heddles for warp threads, hook elements connected to the heddles, upward and downward moving knives to which the hook elements can hook onto, spring elements on the hook elements, actuators for controlling movement of the spring elements and allowing the hook elements to selectively hook or not hook onto the upward and downward moving knives, each hook element having at least two spring elements formed as double laminated springs, at least two of the spring elements having hooks for working together with the knives, at least one actuator on a selector frame of the shed-forming device for selectively influencing the spring elements, and at least one retaining hook for retaining the hook element when one or more spring elements are influenced by an actuator such that the hooks on the spring legs do not hook onto the upward and downward moving knives.

2. The device of claim 1, wherein each hook comprises a supporting element having on both sides at least two spring legs of different lengths, wherein at least the longest legs on both sides of the supporting element are provided with a hook for working together with at least one set of knives moving in opposite phase on both sides of the hook element, wherein the selector frame comprises at least one actuator for influencing the spring legs, and at least one retaining hook is provided on both sides of every hook element for retaining the hook element.

3. The device of claim 1, adapted for a two-position open-shed jacquard weaving device wherein the supporting element is provided on both sides with two spring legs of different lengths formed as one double spring element on both sides of the supporting element, each longest leg on both sides of the supporting element having a hook for working together with one set of knives moving in opposite phase on both sides of the hook element, each selector frame comprising one actuator for influencing the spring legs, and a retaining hook on both sides of every hook element on or nearby the actuator for retaining the shortest spring legs in a position influenced by the actuator.

4. The device of claim 1, wherein the supporting element is provided on both sides with at least two spring legs, in the form of a double laminated or partially double spring element on both sides of the supporting element, a hook on each longer leg of the double laminated spring element on both sides of the supporting element for working together with a first set of top knives moving in opposite phase on both sides of the hook element, two hooks on each shorter leg of the double laminated spring element on both sides of the supporting element for working together at different heights with a second set of bottom knives moving in opposite phase on both sides of the hook element, each selector frame comprises at least three actuators in order to influence the spring legs in different positions of the hook element, and a locking mechanism for retaining the hook element at selected heights when the actuators influence the spring legs such that the hooks on the spring legs do not hook onto the upward and downward moving knives.

5. The device of claim 4, wherein the locking mechanism comprises one or more retaining hooks on both sides of each hook element for retaining the hook element at selected heights when the actuators influence the spring legs.

6. The device of claim 4, wherein the locking mechanism retains the hook element in a top position and in a middle position.

7. The device of claim 1, wherein the supporting element consists of a carriage, and further comprising a channel in the selector frame for guiding the carriage.

8. The device of claim 7, wherein the carriage comprises wings forming a sliding set with the channel in the selector frame for guiding the supporting element.

9. The device of claim 1, wherein the supporting element consists of a roller trolley running in a groove in the selector frame of the shed-forming device, and a roller and slot set adapted for guiding the supporting element.

10. The device of claim 1, wherein the two spring elements are formed of a double laminated spring element or a double split spring element.

11. The device of claim 1, wherein the actuators are electromagnetic and piezoelectric actuators.

12. The device of claim 1, wherein the actuators are electromagnetic actuators.

13. The device of claim 1, wherein the actuators are piezoelectric actuators.

* * * * *